US011673844B2

(12) United States Patent
Forrest et al.

(10) Patent No.: US 11,673,844 B2
(45) Date of Patent: Jun. 13, 2023

(54) EXPLOSIVE DEVICE COMPRISING AN EXPLOSIVE MATERIAL HAVING CONTROLLED EXPLOSIVE PROPERTIES

(71) Applicant: National Technology & Engineering Solutions of Sandia, LLC, Albuquerque, NM (US)

(72) Inventors: Eric Christopher Forrest, Albuquerque, NM (US); Robert Knepper, Albuquerque, NM (US); Alexander S. Tappan, Albuquerque, NM (US); Michael P. Marquez, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 102 days.

(21) Appl. No.: 17/737,173

(22) Filed: May 5, 2022

(65) Prior Publication Data

US 2022/0289642 A1 Sep. 15, 2022

Related U.S. Application Data

(62) Division of application No. 16/186,946, filed on Nov. 12, 2018, now Pat. No. 11,358,910.

(60) Provisional application No. 62/597,650, filed on Dec. 12, 2017.

(51) Int. Cl.

| | |
|---|---|
| ***C06B 45/32*** | (2006.01) |
| ***C06B 45/00*** | (2006.01) |
| *C06B 45/18* | (2006.01) |
| *C06B 45/30* | (2006.01) |
| *C06B 25/00* | (2006.01) |
| *C06B 25/32* | (2006.01) |
| *D03D 23/00* | (2006.01) |
| *D03D 43/00* | (2006.01) |

(52) U.S. Cl.
CPC ..... *C06B 45/00* (2013.01)

(58) Field of Classification Search
USPC .. 149/2, 3, 5, 6, 88, 93, 109.2, 109.4, 109.6
See application file for complete search history.

(56) References Cited

U.S. PATENT DOCUMENTS

| | | | | |
|---|---|---|---|---|
| 3,617,401 | A | 11/1971 | Mortensen | |
| 4,585,496 | A | 4/1986 | Honeyman et al. | |
| 7,597,046 | B1 * | 10/2009 | Laib | F42C 15/184 149/109.6 |
| 7,771,550 | B2 | 8/2010 | Halander et al. | |
| 9,435,625 | B2 | 9/2016 | Halander et al. | |

(Continued)

*Primary Examiner* — James E McDonough
(74) *Attorney, Agent, or Firm* — Calfee, Halter & Griswold LLP; Samantha Updegraff

(57) ABSTRACT

An explosive device is described herein, wherein the explosive device includes a substrate that has a surface, wherein surface energy of a portion of the surface of the substrate has been modified in a vacuum chamber from a first surface energy to a second surface energy. The explosive device additionally includes explosive material that has been deposited on the surface of the substrate in the vacuum chamber by way of physical vapor deposition (PVD), wherein the explosive material is deposited on the portion of the surface of the substrate subsequent to the surface energy of the portion of the surface of the substrate being modified from the first surface energy to the second surface energy.

20 Claims, 9 Drawing Sheets

(56) References Cited

U.S. PATENT DOCUMENTS

| | | | | |
|---|---|---|---|---|
| 10,093,591 | B2 | 10/2018 | Cooper et al. | |
| 2005/0072502 | A1 * | 4/2005 | Hofmann | C06B 33/00<br>149/37 |

* cited by examiner

EXPLOSIVE DEVICE COMPRISING AN EXPLOSIVE MATERIAL HAVING CONTROLLED EXPLOSIVE PROPERTIES

RELATED APPLICATIONS

This application is a divisional of U.S. patent application Ser. No. 16/186,946, filed on Nov. 12, 2018, and entitled "EXPLOSIVE DEVICE COMPRISING AN EXPLOSIVE MATERIAL HAVING CONTROLLED EXPLOSIVE PROPERTIES", which claims priority to U.S. Provisional Patent Application No. 62/597,650, filed on Dec. 12, 2017, and entitled "DENSIFICATION OF VAPOR-DEPOSITED ENERGETIC MATERIALS." The entireties of these applications are incorporated herein by reference.

STATEMENT OF GOVERNMENTAL INTEREST

This invention was made with Government support under Contract No. DE-NA0003525 awarded by the United States Department of Energy/National Nuclear Security Administration. The U.S. Government has certain rights in the invention.

BACKGROUND

Explosives are used in various commercial and defense applications. Conventionally, in order to create an explosive device, an explosive powder is formed by, for example, using wet chemical synthesis techniques, where particle size of the explosive powder is controlled by either recrystallizing from an appropriate solvent and/or techniques such as fluid energy milling. Subsequently, the explosive powder can be pressed into a desired shape. This conventional approach for constructing explosive devices results in performance variability across different explosive devices. In other words, two explosive devices made by way of the same process may have different properties, such as different densities and porosities. These differences in explosive properties result in differences in detonation velocities across explosive devices, wherein detonation velocity refers to a speed at which a reaction front moves through explosive material.

With more specificity, density and porosity are key parameters that dictate ignition and/or detonation characteristics of energetic (explosive) materials, such as initiation threshold, sensitivity, detonation velocity, and detonation energy (output). Explosive material performance, especially detonation velocity and sensitivity, is subject to a large degree of inherent variability, leading to less predictable performance. Detonation performance variability is most likely due to local and bulk variation in density and pore size.

For high explosives (explosives having a detonation front that is faster than the speed of sound in the material), porosity influences sensitivity, which is a crucial parameter in detonators. Density impacts detonation velocity and overall output. Conventional explosive processing entails either melt casting (e.g., with trinitrotoluene (TNT) formulations) or pressing of powders, as described above. Preparation of explosives using such techniques leads to inherent variability in explosive material density and porosity, which in turn leads to-sub optimal detonation characteristics.

Approaches have been proposed to control properties of explosive materials. These approaches entail use of microscale engineering and micro-electromechanical system (MEMS) fabrication-based techniques, where films of explosive material are modified at the microscale following formation of the film. This approach, however, is quite costly, as post deposition processing of energetic films is very expensive.

SUMMARY

The following is a brief summary of subject matter that is described in greater detail herein. This summary is not intended to be limiting as to the scope of the claims.

Described herein are various technologies pertaining to controlling properties of explosive (energetic) material in an explosive device, wherein such properties include density of the explosive material and/or porosity of the explosive material. By controlling the properties of the explosive material of an explosive device, the explosive device can be manufactured to have a desired detonation front velocity, detonation wave shape, and/or the like. Accordingly, as will be described in greater detail herein, an explosive device can be formed of explosive material that has a desired density and porosity. In another example, the explosive device can have patterns of densities and/or porosities across the explosive material, thereby providing for increased control of detonation velocity, detonation wave shape, and other explosive properties.

The aforementioned properties of the explosive material can be controlled by controlling surface energy of a substrate upon which the explosive material is deposited, wherein the higher the surface energy, the greater the density and the lesser the porosity. The surface energy of the surface upon which the explosive material is deposited can be controlled in a variety of manners. For instance, in a vacuum, a substrate (e.g., formed of silicon, plastic, metal, etc.) can be subjected to etching techniques (e.g., argon ion sputtering), wherein surface of the substrate that has been subject to etching has a higher surface energy than the surface of the substrate prior to etching. Once the surface energy of the substrate is increased, explosive material can be deposited onto the surface of the substrate by way of physical vapor deposition (PVD).

In such an example, it is to be noted that the substrate remains in the vacuum environment. In other words, once the surface of the substrate is subjected to etching, the substrate is not removed from the vacuum environment, as removal of the substrate from the vacuum environment may result in the surface energy of the substrate being decreased. In another example, surface energy of the substrate can be increased by depositing a high surface energy material onto the substrate, such as a metal (e.g., aluminum, copper, etc.). Therefore, for instance, a thin layer of aluminum can be deposited on a silicon substrate in vacuum, resulting in a relatively high surface energy. Without removing the substrate from the vacuum environment, the explosive material is deposited onto the high surface energy metallic surface, resulting in the explosive material having a higher density and lower porosity than what would be observed if the surface energy of the substrate were unchanged.

In yet another example, the physical structure of the surface of the substrate can be modified by way of etching, such that trenches and peaks of desired shapes are created on the surface of the substrate. Subsequently, the explosive material can be deposited onto the modified surface of the substrate, wherein in the underlying structure of the substrate impacts density and or porosity of the explosive material once deposited onto such surface. Combinations of these approaches can be employed in connection with controlling the surface energy of a substrate upon which explosive material is to be deposited. Still further, it is to be understood that surface energy at different portions of a substrate can be controlled such that explosive material deposited onto the surface of the substrate will have different explosive properties at different locations on the substrate. This allows for an explosive property to be finely controlled at any point on the surface of the substrate, which in turn allows for an explosive device to be manufactured that has a controlled detonation velocity and/or detonation wave shape.

The explosive material, in an example, may be a high explosive such as pentaerythritol tetranitrate (PETN). In other examples, the explosive material can comprise hexanitroazobenzene (HNAB), hexanitrostilbene (HNS), trinitrotoluene (TNT) formulations, etc. Further, the explosive device referenced above can be included in a high explosive train such that the explosive device can be included in an initiator, a booster charge, or a main charge. In another example, the explosive device can act as a combined initiator-booster. In still yet another example, the explosive device may be included in a low explosive train, such that the explosive device can be included in a primer, an igniter, or a main charge.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

DETAILED DESCRIPTION

Figure 1:
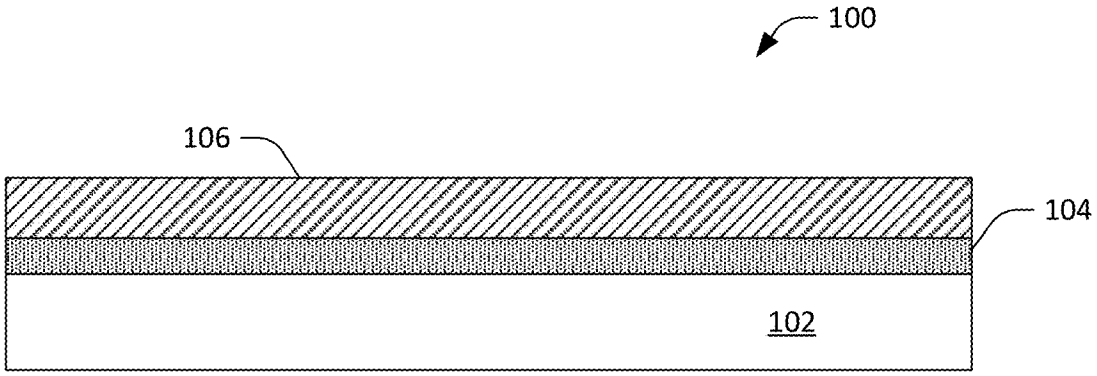
FIG. 1 is a cross-sectional view of an exemplary explosive device.

Described herein are various technologies pertaining to an explosive device, wherein the explosive device includes a substrate upon which an explosive material is deposited, and further wherein a surface energy of the substrate is modified (increased or decreased) prior to the explosive material being deposited onto the surface of the substrate. These technologies are now described with reference to the drawings, wherein like reference numerals are used to refer to like elements throughout. In the following description, for purposes of explanation, numerous specific details are set forth in order to provide a thorough understanding of one or more aspects. It may be evident, however, that such aspect(s) may be practiced without these specific details. In other instances, well-known structures and devices are shown in block diagram form in order to facilitate describing one or more aspects. Further, it is to be understood that functionality that is described as being carried out by certain system components may be performed by multiple components. Similarly, for instance, a component may be configured to perform functionality that is described as being carried out by multiple components.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

Described herein are various technologies pertaining to an explosive device, wherein the explosive device includes a substrate upon which an explosive material is deposited, and further wherein a surface energy of the substrate is modified (increased or decreased) prior to the explosive material being deposited onto the surface at the surface of the substrate. Explosive properties of the explosive material (such as detonation velocity and detonation sensitivity) are a function of density and porosity of the explosive material. The density and porosity of the explosive material have been identified by the inventors as being a function of the surface energy of a surface of a substrate upon which the explosive material is deposited; specifically, the higher the surface energy of the surface of the substrate upon which the explosive material is deposited, the greater the density and the lesser the porosity of the explosive material.

With reference now to FIG. 1, a cross-sectional view of an exemplary explosive device 100 is illustrated. The explosive device 100 includes a substrate 102, wherein the substrate 102 has a surface 104. The explosive device 100 further includes an explosive material 106 that is deposited on the surface 104 of the substrate 102. The substrate 102 can be formed of any suitable material such as silicon, a plastic, a metal, or the like. Further, while the substrate 102 is illustrated as being planar in nature (such as a silicon wafer), it is to be understood that the substrate 102 may have any suitable shape that is desired. For instance, the substrate 102 may be cylindrical, such that the surface 104 of the substrate 102 is curved.

As will be described in greater detail herein, the surface energy of the substrate 104 has been modified prior to the explosive material 106 being deposited upon the surface 104 of the substrate 102. The surface energy of the surface 104 of the substrate 102 can be modified in a variety of manners. In a first example, the surface 104 of the substrate 102 may be subjected to etching in a vacuum environment, which results in altering the surface energy of the surface 104 of the substrate 102 from a first surface energy to a second surface energy, where the second surface energy is higher than the first surface energy. An exemplary etching process is argon ion sputtering, although other types of etching are contemplated. Further, in an example, the second surface energy can be between 300 $mJ/m^2$ and 3000 $mJ/m^2$. Once the surface energy of the surface 104 of the substrate 102 has been increased (due to etching), and without removing the substrate 102 from the vacuum environment, the explosive material 106 is deposited upon the surface 104 of the substrate 102.

Properties of the explosive material 106, when deposited onto the surface 104 of the substrate 102, are a function of the surface energy of the surface 104 of the substrate 102 at the time that the explosive material 106 is deposited thereon. For example, as the surface energy of the surface 104 of the substrate 102 increases, the density of the explosive material 106 increases and the porosity of the explosive material 106 decreases. In turn, explosive properties of the explosive material 106 are a function of the density and porosity of the explosive material 106. Specifically, the greater the density, the greater the detonation velocity of the explosive material 106. As will be described in greater detail herein, the surface energy of the surface 104 of the substrate 102 can be controlled such that the detonation velocity of the explosive material 106 can be controlled. In addition, sensitivity of the explosive material 106 is a function of the porosity of the explosive material 106. As referenced above, the porosity of the explosive material 106 is a function of the surface energy of the surface 104 of the substrate 102 upon which the explosive material 106 is deposited. Accordingly, the sensitivity of the explosive device 100 can be defined based upon the surface energy of the surface 104 of the substrate 102 upon which the explosive material 106 is deposited.

Another exemplary approach for modifying the surface energy of the surface 104 of the substrate 102 includes depositing, in a vacuum environment, a thin film of high surface energy material (such as aluminum or copper) onto the substrate 102, such that the surface 104 of the substrate 102 has an increased surface energy. As with the first example set forth previously, the explosive material 106 is deposited onto the surface 104 (formed of the high surface energy material) while the substrate 102 remains in vacuum. Removing the substrate 102 from vacuum prior to depositing the explosive material 106 thereon can result in contamination of the surface 104 of the substrate 102, which decreases the surface energy of the surface 104 of the substrate 102.

In a third example, the surface energy of the surface 104 of the substrate 106 can be modified by physically modifying the surface 104 of the substrate 102 (e.g., etching trenches into the surface 104 of the substrate). The etched regions can exhibit higher surface energy than unetched regions. Further, molecules of the explosive material 106 align in accordance with the underlying surface structure, thereby enabling control of properties of the explosive material 106.

The explosive material 106 can be any suitable explosive material that can be deposited onto a surface of a substrate by way of physical vapor deposition (PVD). For example, the explosive material 106 can comprise a low explosive and/or a high explosive. More specifically, the explosive material 106 can comprise trinitrotoluene (TNT) formulations, hexanitroazobenzene (HNAB), hexanitrostilbene (HNS), pentaerythritol tetranitrate (PETN), amongst other explosives.

The explosive device 100, in an exemplary embodiment, can be included in a low explosive train. Thus, the explosive device 100 can be a primer, an igniter, a nitrocellulose propellant (main charge), or can be a combination of two of such elements (e.g., the primer and the igniter). In another example, the explosive device 100 can be included in a high explosive train. Hence, the explosive device can be an initiator, a booster charge, a main charge, or a combination of two of such elements (e.g., the initiator and the booster charge). In still yet another example, the explosive device 100 can be a detonating cord.

Figure 2:
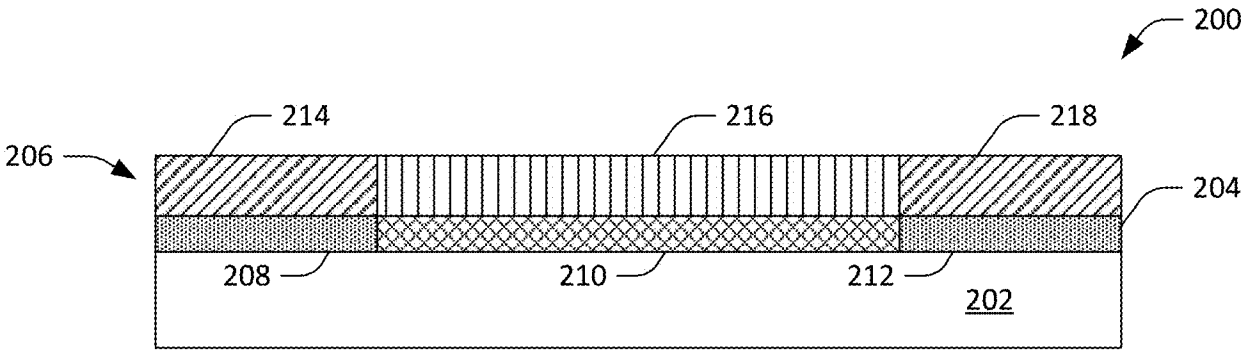
FIG. 2 is a cross-sectional view of another exemplary explosive device.

Now referring to FIG. 2, another exemplary explosive device 200 is illustrated. The explosive device 200 includes a substrate 202, which has a surface 204. The explosive device 200 additionally includes an explosive material 206 that is deposited on the surface 204 of the substrate 202. Prior to the explosive material 206 being deposited upon the surface 204 of the substrate 202, and in vacuum, the surface energy of the surface 204 of the substrate 202 is patterned such that different portions of the surface 204 of the substrate 202 have different surface energies. With more specificity, the surface 204 of the substrate 202 includes three portions: 1) a first portion 208; 2) a second portion 210; and 3) a third portion 212. The first portion 208 and the third portion 212 have a first surface energy, while the second portion 210 has a second surface energy that is different from the first surface energy. For example, the first portion 208 and the third portion 212 of the surface 204 of the substrate 202 may have been subjected to etching (e.g., argon ion sputtering), while the second portion 210 may have been masked during etching, thereby causing the first portion 208 and the third portion 212 to have higher surface energy than the second portion 210. In another example, the first portion 208 and the second portion 212 of the surface 204 of the substrate 202 can be subjected to etching for a first amount of time, while the second portion 210 of the surface 204 the substrate 202 may be subjected to etching for a second amount of time that is different from the first amount of time (resulting in the first and third portions 208 and 212 having different surface energies than the second portion 210). While the examples above refer to argon ion sputtering to pattern surface energy across the surface 204 of the substrate 202, it is to be understood that the other semiconductor fabrication processes can be employed to pattern surface energy across the surface 204 of the substrate 202, and such fabrication processes are contemplated and intended to fall within the scope of the hereto-appended claims.

Without removing the substrate 202 from vacuum, the explosive material 206 is deposited onto the surface 204 of the substrate 202 by way of PVD. This results in different portions of the explosive material 206 having different properties. For instance, the explosive material 206, when deposited onto the surface 204 of the substrate 202, includes three portions: 1) a first portion 214; 2) a second portion 216; and 3) a third portion 218. The first portion 214 of the explosive material 206 is deposited onto the first portion 208 of the surface 204 of the substrate 202, the second portion 216 of the explosive material 206 is deposited onto the second portion 210 of the surface 204 of the substrate 202, and the third portion 218 of the explosive material 206 is deposited onto the third portion 212 of the surface 204 of the substrate 202. Due to the portions 208 and 210 of the surface 204 of the substrate 202 having different surface energies, properties of the first portion 214 and the second portion 216 of the explosive material 206 will be different from one another. That is, the first portion 214 of the explosive material 206 may have a higher density and lower porosity than the second portion 216 of the explosive material 206 due to the surface energy of the first portion 208 of the surface 204 of the substrate 202 being higher than the surface energy of the second portion 210 of the surface 204 of the substrate 202.

Hence, the explosive material 206 may have a pattern of explosive properties throughout its cross-section. This pattern can be formed to cause the explosive device 200, when detonated, to have a desired detonation wave shape and/or detonation velocity. Put differently, the surface energy on the portions 208-212 of the surface 204 of the substrate 202 can be patterned such that the wave shape formed when the explosive device 200 is detonated is as desired. For instance, the surface energy on the surface 204 of the substrate 202 can be patterned to cause the explosive device 200 to be a line-wave generator.

Figure 3:
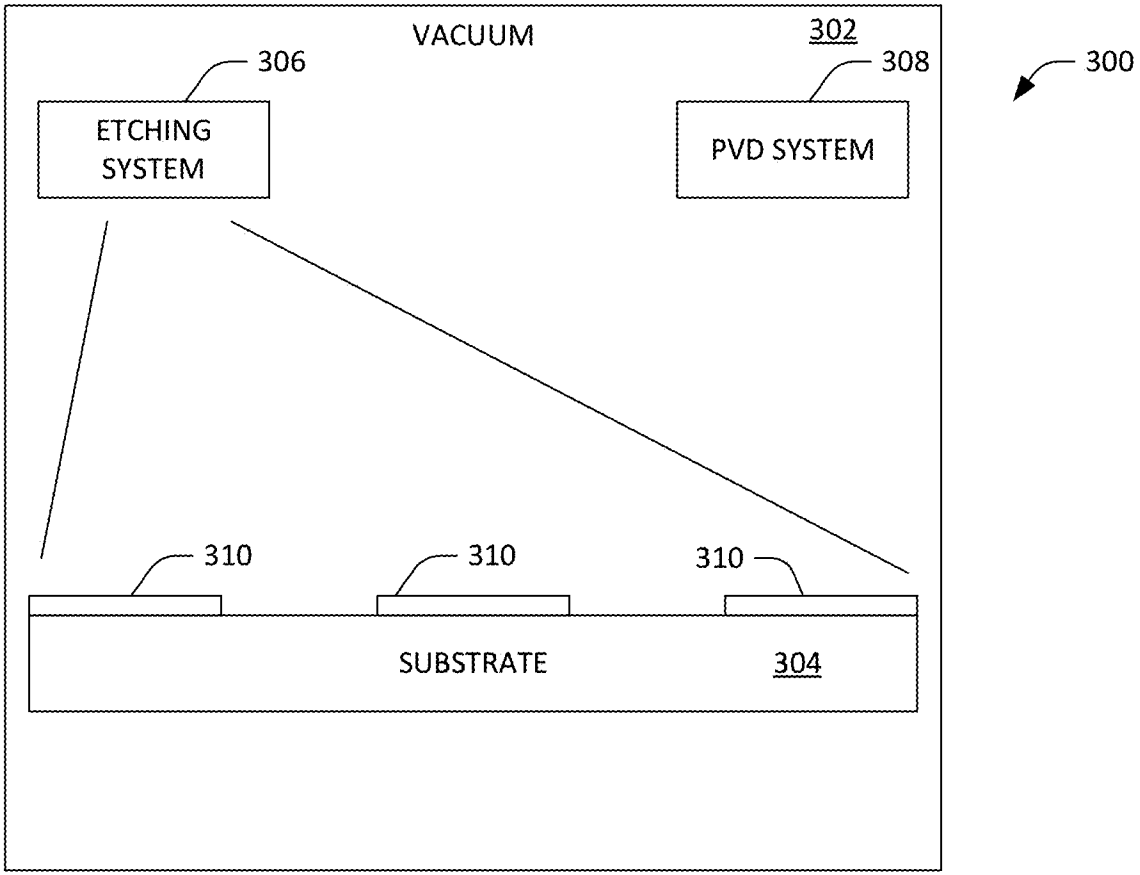
FIGS. 3-5 are functional block diagrams of a system that is configured to create an explosive device with controlled explosive properties.
Figure 4:
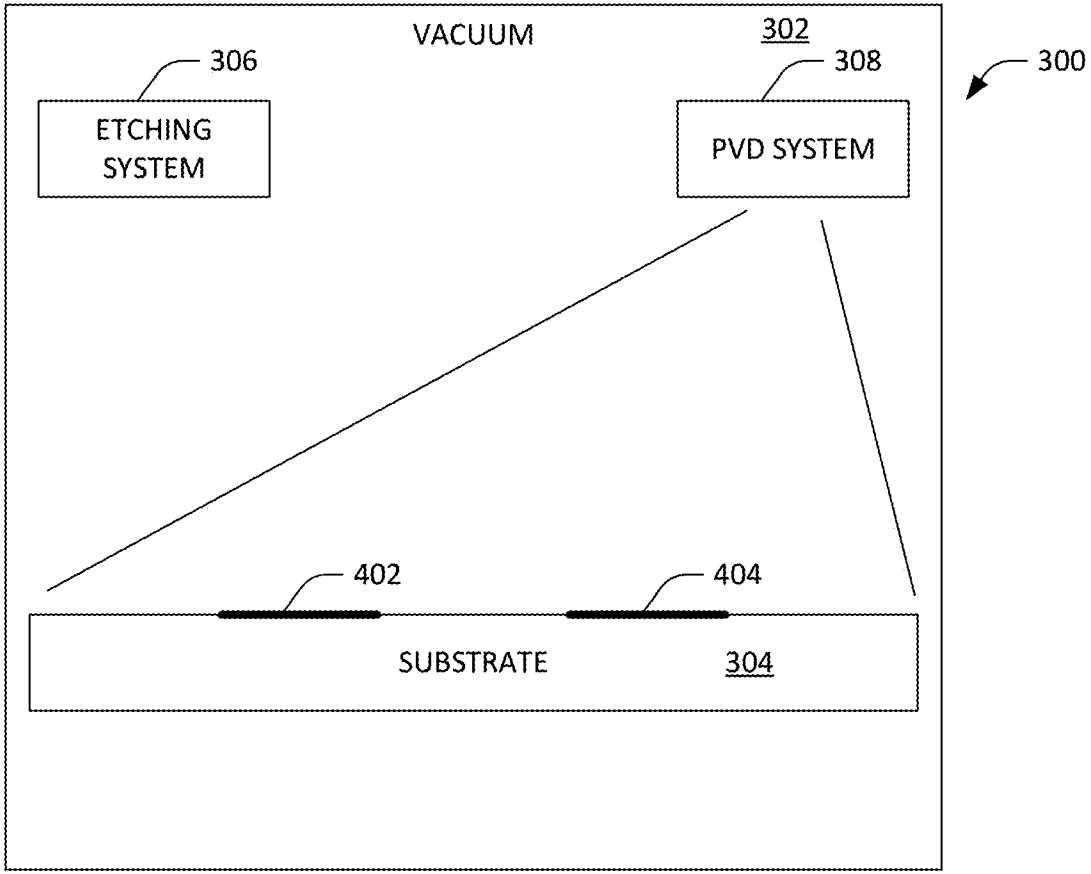
Figure 5:
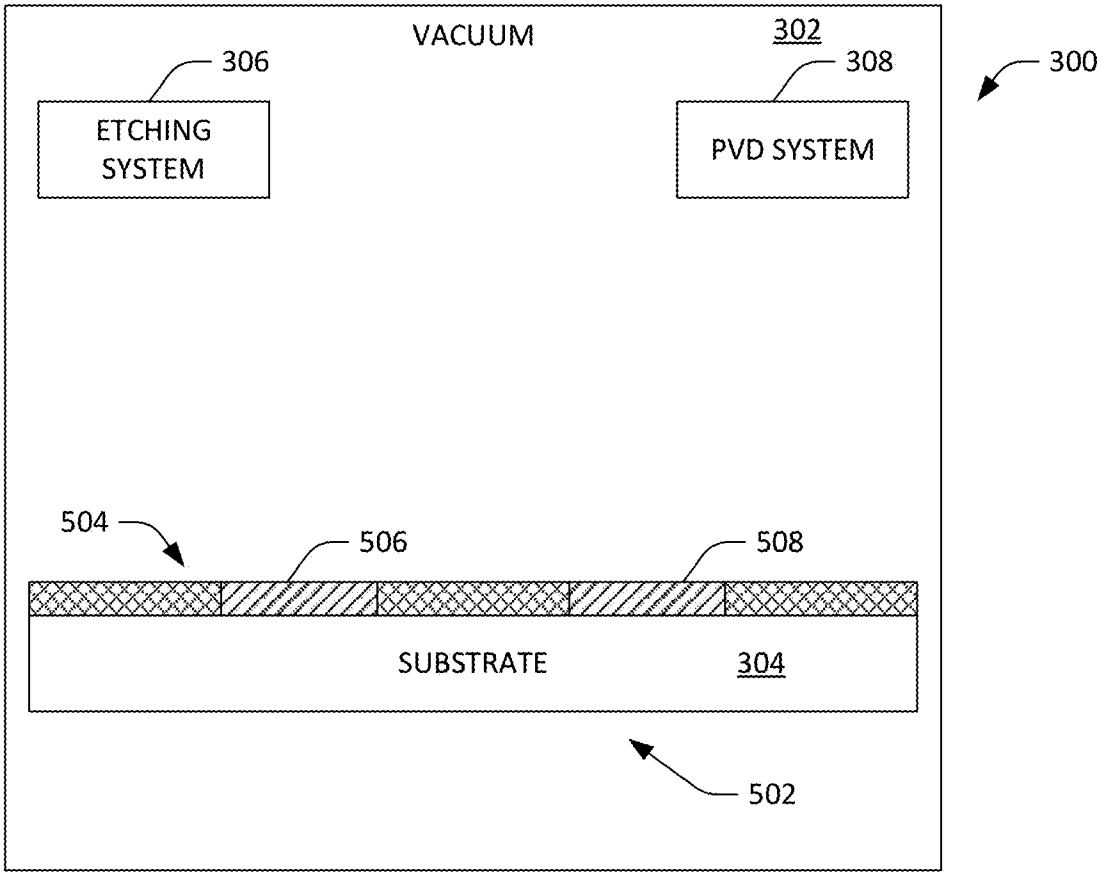

Referring now to FIGS. 3-5, a system 300 that is configured to create an explosive device and processing undertaken by such system 300 when creating the explosive device is illustrated. With reference now solely to FIG. 3, the system 300 includes a vacuum environment 302 within which a substrate 304 is placed. The system 300 additionally includes an etching system 306 that is positioned in the vacuum environment 302, as well as a PVD system 308 that is also positioned in the vacuum environment 302. A mask 310 is positioned over portions of the surface of the substrate 304.

The etching system 306 performs an etching process, such that the surface of the substrate 304 is modified. In an example, the etching system can be a sputtering system, where high-energy particles (e.g., ions) are directed towards the substrate 304. In the sputtering process, the mask 310 prevents portions of the substrate 304 that lie beneath the mask 310 from being bombarded by the high-energy particles, while the uncovered portions of the substrate 304 are impacted by high-energy particles during sputtering.

Now referring to FIG. 4, a subsequent step in the process of forming an explosive device is illustrated. Subsequent to etching of the substrate 304 being completed, the mask 310 is removed and the PVD system 308 deposits a film of explosive material onto the substrate 304. The surface of the substrate 304 has two portions 402 and 404 that were not masked during etching, where these two portions 402 and 404 have higher surface energy than portions that were beneath the mask 310. It is further to be emphasized the substrate 304 remains in vacuum after the etching system 306 has completed etching, such that the PVD system 308 deposits explosive material onto the surface of the substrate 304 without the substrate 304 being removed from the vacuum environment 302 after etching.

FIG. 5 depicts a formed explosive device 502, which includes a film 504 of explosive material deposited on the substrate 304 by the PVD system 308. The film 504 of explosive material has different densities and/or porosities at different portions of the film 504. For instance, the film 504 of explosive material includes portions 506 and 508 that are positioned above the areas 402 and 404 on the surface of the substrate 304 that have higher surface energies than other areas on the surface of the substrate 304. The result is that the densities of the portions 508 and 506 of the film 504 of explosive material is higher than the densities of other portions of the film 504 of explosive material.

Using the approach illustrated in FIGS. 3-5, in an example, a composite high explosive device can be created with spatially varying sensitivity, wherein the explosive device 502 combines the function of an initiator and a booster into a single device, thereby simplifying the explosive train and enhancing safety and reliability by eliminating the need for primary explosives. In addition, using the approach illustrated in FIGS. 3-5, graded-density explosive films can be formed, where such films comprise secondary high explosive material with spatially varying porosity and density. Hence, the resultant explosive device can have higher sensitivity in one region (for initiation) and higher output in another region for greater reliability and setting off the main charge. Further, as noted previously, creating a graded-density film of explosive material allows for detonation wave-shaping, thereby allowing for creation of miniaturized initiators and other energetic devices.

Embodiments of the aspects described herein allow for control of energetic film morphology, specifically density, grain size, and porosity. Aspects described herein require only modification of the substrate to achieve a desired control over energetic material density, grain size, and porosity; post-fabrication or processing of energetic material is not required. Aspects described herein enhance detonation velocity, detonation output, and allow for control over detonation sensitivity.

In an exemplary embodiment, an explosive device created by way of the aspects described herein includes densified PETN, vapor deposited within a cylindrical liner of flexible cloth or plastic whose surface has been prepared to achieve the aforementioned enhancement in surface energy through deposition of thin films of metal in vacuum immediately prior to energetic material deposition, thereby making a detonating cord with improved characteristics (faster and more consistent detonation velocity).

In another exemplary embodiment, an explosive device described herein may be an improved mild detonating fuze, where a sheath material of lead, aluminum, or silver is prepared in vacuum by way of exposure to a Hall-current argon ion source, immediately followed by vapor deposition of an explosive material.

In yet another exemplary embodiment, an explosive device formed by way of the aspects described herein can be a graded-density initiator or blasting cap, which have regions of varying density achieved through variation in surface energy of the substrate upon which energetic material is deposited. The explosive device includes a substrate with a more porous, less dense vapor deposited energetic material such as PETN at the region of initiation for improved sensitivity, with the region exposed to the main charge comprising densified, non-porous vapor-deposited energetic material for higher detonation velocity and output. Such an initiator reduces complexity, reduces size, and improves safety compared to conventional initiators (through elimination of booster charges and primary high explosives).

Further, as mentioned above, an initiator using density wave shaping is achieved through vapor deposition on heterogeneous surfaces with patterned surface energy achieved through the techniques described herein. For example, a heterogeneous substrate can comprise sections of aluminum exposed to a Hall ion source at the outer edges, intermixed with sections comprising polyimide, thereby enabling flattening of the detonation wave during use, resulting in more consistent detonation in a smaller initiator package when compared to conventional initiators.

Figure 6:
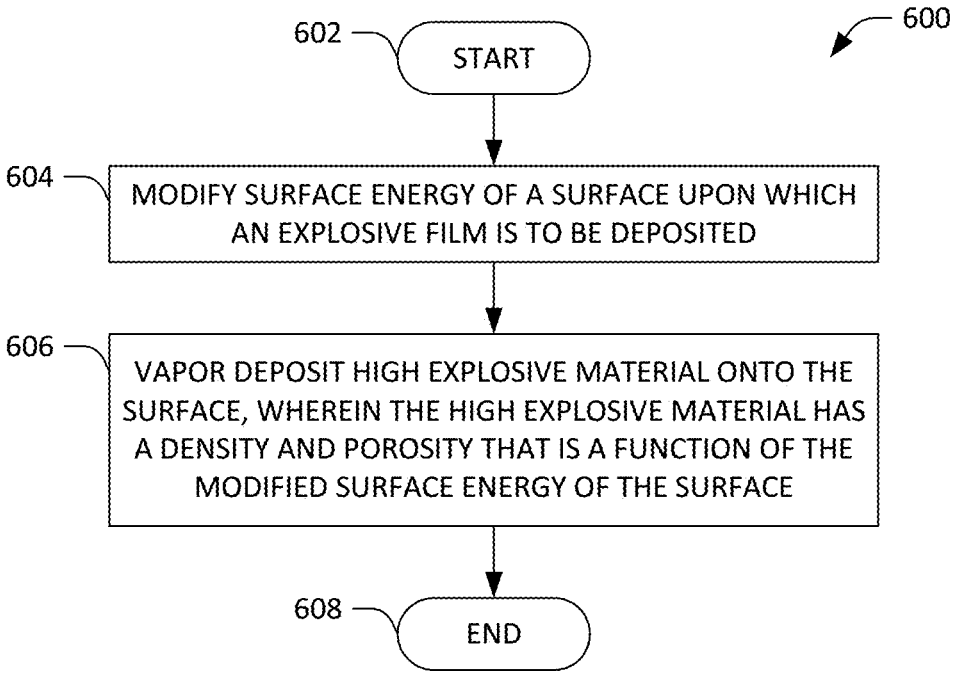
FIG. 6 is a flow diagram illustrating an exemplary methodology for creating an explosive device, wherein explosive material in the explosive device has a density and porosity that is a function of a modified surface energy of a surface upon which the explosive material is deposited.
Figure 7:
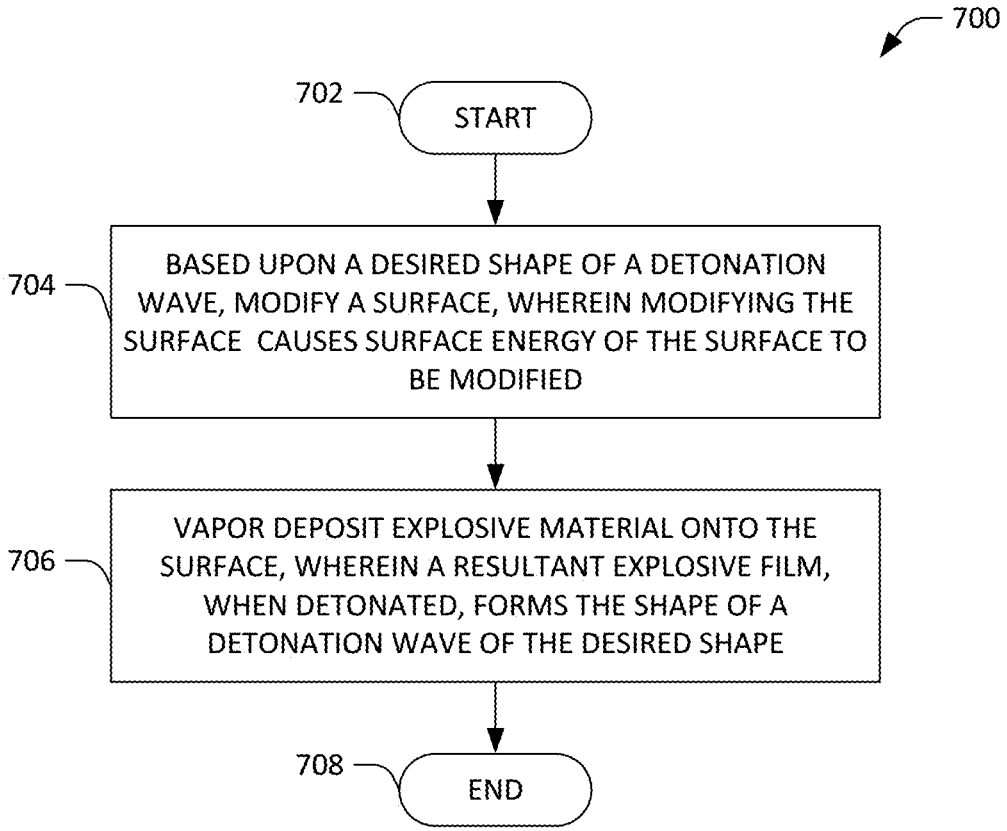
FIG. 7 is a flow diagram illustrating an exemplary methodology for producing an explosive device that, when detonated, has a desired detonation wave shape.

FIGS. 6-7 illustrate exemplary methodologies relating to creating explosive devices. While the methodologies are shown and described as being a series of acts that are performed in a sequence, it is to be understood and appreciated that the methodologies are not limited by the order of the sequence. For example, some acts can occur in a different order than what is described herein. In addition, an act can occur concurrently with another act. Further, in some instances, not all acts may be required to implement a methodology described herein.

Now referring to FIG. 6, a flow diagram illustrating an exemplary methodology 600 for creating an explosive device is illustrated. The methodology 600 starts at 602, and is 604 surface energy of a surface upon which an explosive film is to be deposited is modified. More specifically the surface energy of the surface is modified in vacuum. As mentioned previously, the surface energy of the surface upon which the explosive film is to be deposited can be modified by way of any suitable type of etching, cleaning of the surface, formation of structures on the surface, or the like.

At 606, without breaking vacuum, a high explosive material such as PETN is vapor-deposited onto the surface, wherein the high explosive material has at least one property that is a function of the modified surface energy of the surface upon which the high explosive material is vapor-deposited. Such property can be density, porosity, grain size, or the like. The methodology 600 completes at 608.

With reference now to FIG. 7, an exemplary methodology 700 for producing an explosive device, such that the explosive device has a desired detonation wave shape is illustrated. The methodology 700 starts at 702, at 704 a desired shape of a detonation wave is identified, and based upon the desired shape of the detonation wave, a surface of a substrate upon which explosive material is to be deposited is modified. Further, the surface energy of the surface of the substrate can be modified to create a desired pattern of surface energy along the surface of the substrate.

At 706, explosive material is vapor-deposited onto the surface of the substrate subsequent to the surface energy of the surface of the substrate being modified. The resultant explosive material deposited onto the surface of the substrate, when detonated, forms a detonation wave having the identified shape. The methodology 700 completes at 708.

Figure 8:
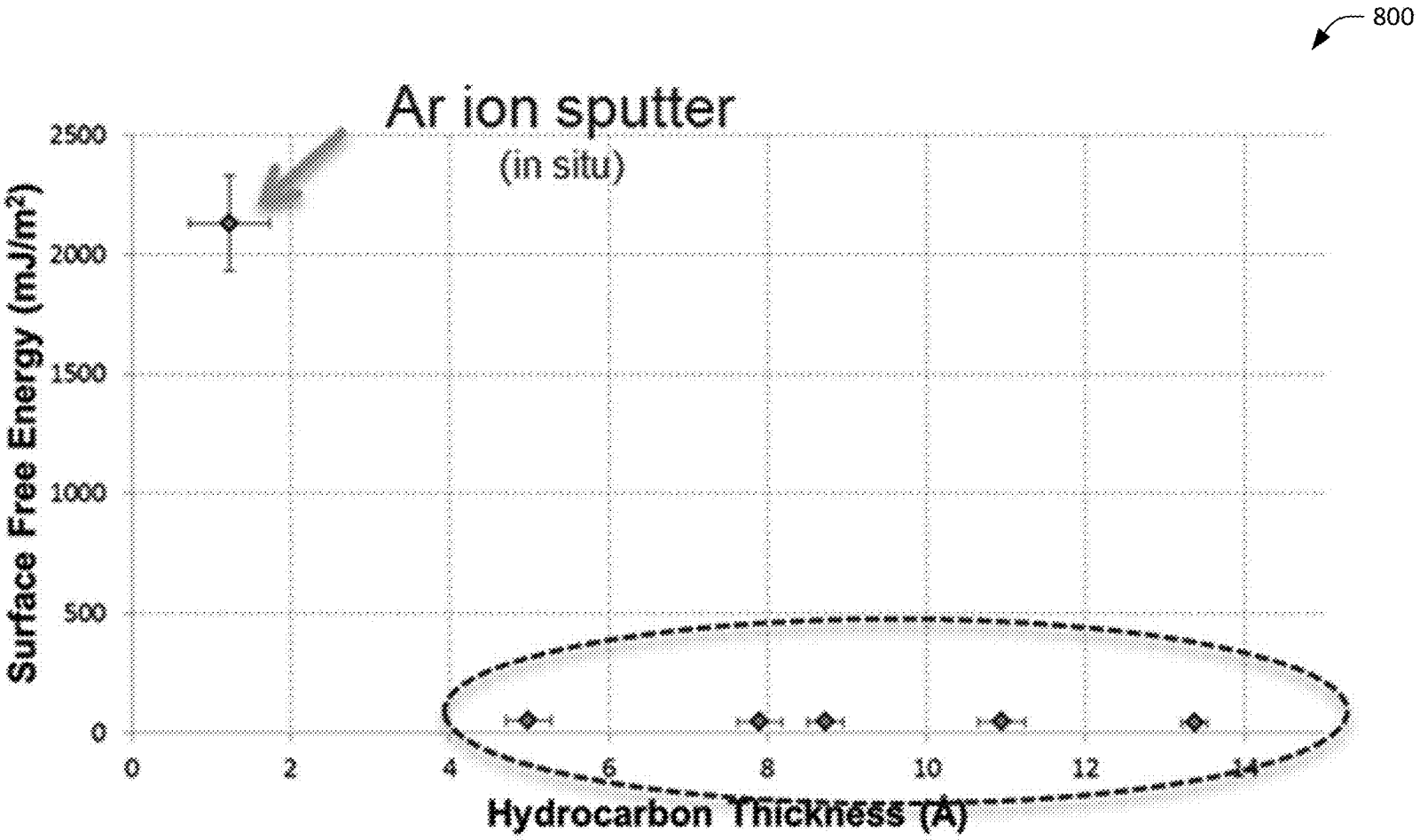
FIG. 8 is a chart that illustrates increased surface free energy on a substrate due to the substrate being subjected to etching.
Figure 9:
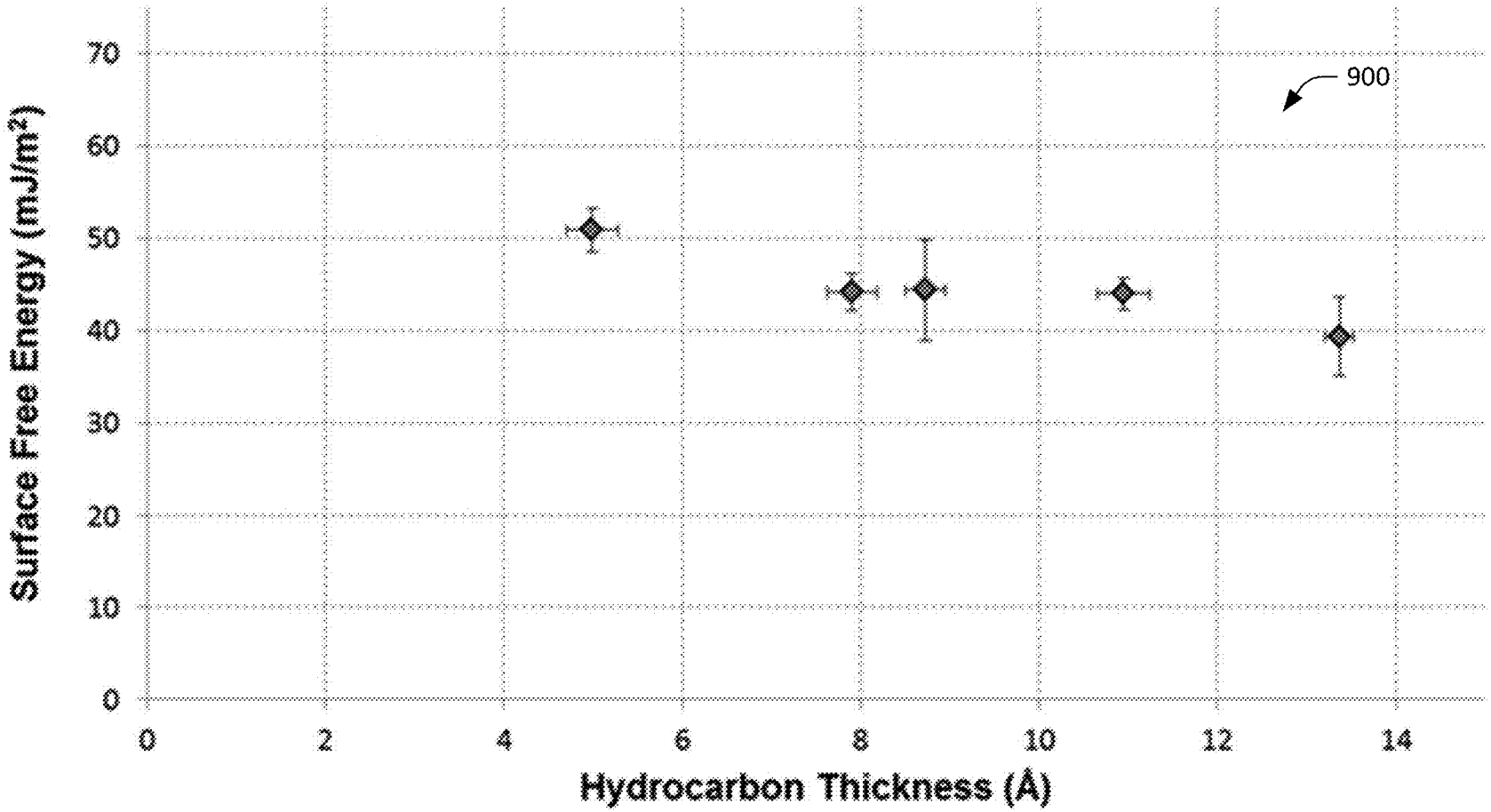
FIG. 9 is a chart that illustrates a relationship between surface energy on a surface of a substrate and a thickness of a hydrocarbon layer on the surface of the substrate.

Referring briefly to FIGS. 8 and 9, charts 800 and 900, respectively, that illustrate the relationship between surface energy of a surface and hydrocarbon thickness upon the surface are depicted. The chart 900 depicted in FIG. 9 is a "close-up" of a portion of the chart 800 shown in FIG. 8. It can be ascertained that surface energy of a surface increases as hydrocarbon thickness on the surface decreases, particularly for relatively low hydrocarbon thicknesses (between zero and 2 Å).

EXAMPLES

Both PETN and aluminum films were deposited in a customer-designed high vacuum system onto a 1×3 cm polycarbonate substrates. Deposition was performed at a typical base pressure of approximately $1\times10^{-6}$ Torr. PETN films were deposited using an effusion cell thermal deposition source. Multiple depositions were typically required to reach the explosive thicknesses used for detonation testing. Aluminum films were deposited in the same vacuum system using electron beam evaporation. Aluminum was deposited both prior to and after PETN deposition to create Al/PETN/Al stacks in which the thicknesses of the two aluminum layers were kept approximately constant within each specimen tested.

Since the microstructure of the PETN films was strongly influenced by the surface energy of the substrate, two different preparations were used—one in which substrates were removed from the vacuum chamber and exposed to atmosphere for at least 24 hours between the aluminum deposition and subsequent PETN deposition, and one where PETN deposition was conducted immediately after the initial aluminum deposition without breaking vacuum. Films deposited on "bare" aluminum were found to be more reflective with a scaled appearance, while films deposited on "oxidized" aluminum were round to have a duller, more uniform appearance.

Contact angle experiments were performed on the aluminum-coated substrates exposed to atmosphere using four different liquids (water, glycerol, ethylene glycol, and diiodemethane) to quantify the surface energy. Data were analyzed using multiple approaches, each of which indicated a total surface free energy of approximately 40 $mJ/m^2$. While unable to measure a "bare" aluminum surface without breaking vacuum, an upper bound was able to be estimated from the theoretical surface energy of a perfectly clean aluminum surface of approximately 1150 $mJ/m^2$. The actual surface energy was likely somewhat lower (though still much higher than surfaces exposed to atmosphere), as a bare aluminum surface will still absorb a small amount of material under high vacuum conditions.

Films were characterizing using stylus profilometry (Bruker Dektak XT), scanning electron microscopy (Zeiss Crossbeam 340), and x-ray diffraction. Single-line profilometer scans were performed to measure film thicknesses, while an array of lines was used to quantify surface roughness. Scanning electron microscope (SEM) images were taken using a 1 kV accelerating voltage to image the top surface morphology of the Al/PETN/Al stacks. Symmetric θ-2θ x-ray scans were taken using a copper x-ray source over a range of 2θ from 5-50° to measure the difference in crystal orientation in the PETN films.

Detonation velocity measurements were performed using a polycarbonate lid containing seven optical fibers (Polymicro Technologies) spaced at regular intervals that was placed over each deposited PETN line. The fibers were terminated in a "six-around-one" fashion in an FC optical fiber connector for assembly into a silicon photodetector (DET10A, ThorLabs) with rise and fall times of 1 ns. Detonation was initiated from a detonating PETN structure that provided an incident shock to the end of the film. The optical fiber probes detected light as the detonation reached and then destroyed each fiber on the lid.

SEM images of Al/PETN/Al stacks deposited on both bare and oxidized aluminum were obtained, where the films in each of the images were composed of 1 μm aluminum layers around a 50 μm PETN film. Films on bare aluminum, in the images, appeared to be largely composed of a series of platelets oriented roughly parallel to the substrate. The smaller grains visible on each platelet were from the top of the aluminum layer. Films deposited on oxidized aluminum appeared, in the images, rougher with more hillocks. Profilometer measurements of surface roughness support this observation, with average roughness values approximately three times greater for films deposited on oxidized aluminum compared with those on bare aluminum ($R_a\approx1$ μm vs. 350 nm). X-ray diffraction patterns for both types of films were also obtained. PETN deposited on bare aluminum showed a very strong (110) out-of-plane texture that appeared to correlate with platelets visible in the SEM image. The films deposited on oxidized aluminum had a more random distribution of crystal orientations, with many different orientations visible in the diffraction pattern. Additionally, deposition of PETN onto an oxidized aluminum surface consistently resulted in a thicker layer than when the same amount of material was deposited onto a bare aluminum surface, leading to the conclusion that films deposited on bare aluminum have a significantly higher density than those on oxidized aluminum.

Detonation velocities were also tested. For films deposited on oxidized aluminum, a general trend toward smaller detonation velocities as PETN thickness decreases was observed. Films with confinement thicknesses of ~510 and 970 nm showed very similar behavior, with detonation velocity decreasing from ~7.4 to 7.2 mm/μs with decreasing explosive thickness and failing to sustain detonation at PETN thicknesses below 55 μm. As confinement thickness decreased to 300 nm, the failure thickness shifted from roughly 55 to 75 μm. Thinner confinement did not show any further shift in failure thickness—only a substantial decrease in detonation velocity.

Films deposited on bare aluminum displayed significantly higher detonation velocities than those deposited on an oxidized surface, generally ranging from ~7.6 to 7.8 mm/μs and having no distinct trend with explosive thickness. While the velocities were higher, detonation was observed to fail to propagate at approximately the same explosive thickness as in the films deposited on oxidized aluminum. Unlike the PETN on oxidized aluminum, failure thickness did not vary in experiments with confinement thickness as small as 275 nm.

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An explosive device comprising:

a substrate having a surface; and an explosive material that is deposited on the surface of the substrate, wherein porosity and density of the explosive material varies across the surface of the substrate, and further wherein the porosity and the density of the explosive material deposited on the surface of the substrate is a function of a surface energy corresponding to the substrate.

2. The explosive device of claim 1, wherein the substrate is formed of at least one of silicon, plastic, or metal.

3. The explosive device of claim 1, wherein the explosive material is at least one of pentaerythritol tetranitrate (PETN), hexanitroazobenzene (HNAB), hexanitrostilbene (HNS), or trinitrotoluene (TNT).

4. The explosive device of claim 1, further comprising:

a layer of metal that has been deposited on the surface of the substrate.

5. The explosive device of claim 4, wherein the metal is aluminum or copper.

6. The explosive device of claim 1, wherein the substrate comprises a first portion and a second portion, wherein the first portion of the substrate has a first surface energy, and further wherein the second portion of the substrate has a second surface energy that is different from the first surface energy.

7. The explosive device of claim 6, wherein the substrate further comprises a third portion, wherein the third portion has the first surface energy.

8. A method for creating an explosive device, the method comprising:

providing a substrate, where the substrate has a surface; and depositing an explosive material on the surface of the substrate, wherein porosity and density of the explosive material varies across the surface of the substrate, and further wherein the porosity and the density of the explosive material deposited on the surface of the substrate are a function of a surface energy corresponding to the substrate.

9. The method of claim 8, wherein the substrate is formed of at least one of silicon, plastic, or metal.

10. The method of claim 8, wherein the explosive material is at least one of pentaerythritol tetranitrate (PETN), hexanitroazobenzene (HNAB), hexanitrostilbene (HNS), or trinitrotoluene (TNT).

11. The method of claim 8, further comprising forming a layer of metal on the surface of the substrate.

12. The method of claim 11, wherein the metal is aluminum or copper.

13. The method of claim 8, wherein the substrate comprises:

a first portion having a first surface energy; and a second portion having a second surface energy.

14. The method of claim 8, wherein the substrate further comprises:

a third portion having the first surface energy.

15. A method comprising:

detonating an explosive device, wherein the explosive device comprises:

a substrate having a surface; and an explosive material that is deposited on the surface of the substrate, wherein porosity and density of the explosive material varies across the surface of the substrate, and further wherein the porosity and the density of the explosive material deposited on the surface of the substrate is a function of a surface energy corresponding to the substrate.

16. The method of claim 15, wherein the substrate is formed of at least one of silicon, plastic, or metal.

17. The method of claim 15, wherein the explosive material is at least one of pentaerythritol tetranitrate (PETN), hexanitroazobenzene (HNAB), hexanitrostilbene (HNS), or trinitrotoluene (TNT).

18. The method of claim 15, wherein a sheath material is applied to the substrate, wherein the sheath material is at least one of lead, aluminum, or silver.

19. The method of claim 15, wherein the substrate comprises:

a first portion having a first surface energy; and a second portion having a second surface energy that is different from the first surface energy.

20. The method of claim 19, wherein the substrate further comprises:

a third portion of the substrate having the first surface energy.

* * * * *